United States Patent [19]

Goudy, Jr.

[11] Patent Number: 4,765,965

[45] **Date of Patent: * Aug. 23, 1988**

[54] MIXER CHARGER REACTION CONTROL SYSTEM AND METHOD OF AFFECTING A CHEMICAL REACTION

[75] Inventor: Paul R. Goudy, Jr., Milwaukee, Wis.

[73] Assignee: Autotrol Corporation, Milwaukee, Wis.

[ * ] Notice: The portion of the term of this patent subsequent to Aug. 4, 2004 has been disclaimed.

[21] Appl. No.: 645,841

[22] Filed: Aug. 29, 1984

[51] Int. Cl.[4] ..... B01F 5/06

[52] U.S. Cl. ..... 422/186; 422/187; 422/186.04; 210/221.2; 210/703; 210/706; 55/10; 55/107; 55/122; 361/226; 361/229; 361/230; 366/182; 261/DIG. 80; 423/659

[58] Field of Search ..... 422/186, 187, 186.04; 366/182; 361/225, 226, 229, 230; 210/293, 760, 192, 221.2, 703, 706; 204/164, 189; 55/106, 10, 107, 122; 261/DIG. 80; 423/659

[56] References Cited

U.S. PATENT DOCUMENTS

| | | | |
|---|---|---|---|
| 1,252,726 | 1/1918 | Schmidt | 422/186 |
| 1,621,143 | 3/1927 | Vogel | 422/186.04 |
| 3,059,910 | 10/1962 | Moriya | 361/225 |
| 3,478,494 | 11/1969 | Lustenader et al. | 210/243 |
| 3,597,668 | 8/1971 | Yoshimine | 361/225 |
| 3,600,632 | 8/1971 | Bright et al. | 361/225 |
| 4,193,774 | 3/1980 | Pilat | 55/107 |
| 4,329,067 | 5/1982 | Goudy, Jr. | 366/182 |
| 4,353,717 | 10/1982 | Herbrechtsmeier et al. | 210/760 |
| 4,386,055 | 5/1983 | McBride | 210/760 |
| 4,410,467 | 10/1983 | Wentworth, Jr. | 261/DIG. 80 |
| 4,507,253 | 5/1985 | Wiesmann | 210/760 |
| 4,563,286 | 1/1986 | Johnson et al. | 210/760 |
| 4,684,063 | 8/1987 | Goudy, Jr. | 239/3 |
| 4,684,254 | 8/1987 | Goudy, Jr. | 261/DIG. 80 |

*Primary Examiner*—Barry Richman
*Assistant Examiner*—Lynn Kummert
*Attorney, Agent, or Firm*—Renner, Otto, Boisselle & Sklar

[57] ABSTRACT

Apparatus and method for effecting a chemical reaction, including a mixer/charger for simultaneously mixing and electrically charging a fluid input to produce a charged fluid output, chemical reaction containment vessel for containing ingredients undergoing a chemical reaction separately from the mixer/charger, and a coupling for fluidically coupling the charged fluid output from the mixer/charger to the containment vessel to influence the chemical reaction. The method includes simultaneously mixing and electrically charging a fluid input to produce an electrically charged fluid output, and delivering the electrically charged fluid to a medium undergoing a chemical reaction to influence the chemical reaction thereof.

10 Claims, 2 Drawing Sheets

MIXER CHARGER REACTION CONTROL SYSTEM AND METHOD OF AFFECTING A CHEMICAL REACTION

TECHNICAL FIELD

The invention relates to reaction affecting apparatus and processes and, more particularly, to the use of charged fluid to affect a chemical reaction.

CROSS REFERENCE TO RELATED APPLICATIONS AND PATENTS

Reference is made to copending, concurrently filed, commonly assigned U.S. patent applications Ser. No. 645,809 for "Fluid Mixer/Charger and Method" and Ser. No. 645,810 for "Particulates Generation and Removal", the entire disclosures of which hereby are incorporated by reference. Reference also is made to U.S. Pat. Nos. 4,259,021 and 4,329,067, the entire disclosures of which also are hereby incorporated by reference. The latter patents relate to several types of motionless mixers, features of which may be employed in accordance with the present invention.

BACKGROUND OF THE INVENTION

Various ingredients have been used to influence the rate and other factors with respect to chemical reactions. One such chemical reaction may be, for example, the reaction of an acid with a base. For example, to alter the acid/base nature of a water sample, it may be desirable to add an acid to water having an excess alkalinity due, for example, to the inclusion of carbonates and bicarbonates in the water.

Catalysts have been used to affect reaction rates and even to enable a reaction to occur.

BRIEF SUMMARY OF INVENTION

According to one aspect of the invention an input fluid is simultaneously mixed and electrically charged to provide a relatively uniformly and long lasting electrically charged fluid output product, and that fluid output product is delivered to a vessel containing plural ingredients undergoing chemical reaction. The rate of chemical reaction and/or other characteristics of the chemical reaction may be influenced by the magnitude of charge of the charged fluid, the volume of the charged fluid, the polarity of the charged fluid, and the polar nature or degree of polarity, of one or more of the ingredients involved in the chemical reaction or otherwise contained in such vessel in which the chemical reaction occurs.

DESCRIPTION OF THE PREFERRED EMBODIMENT

Figure 1:
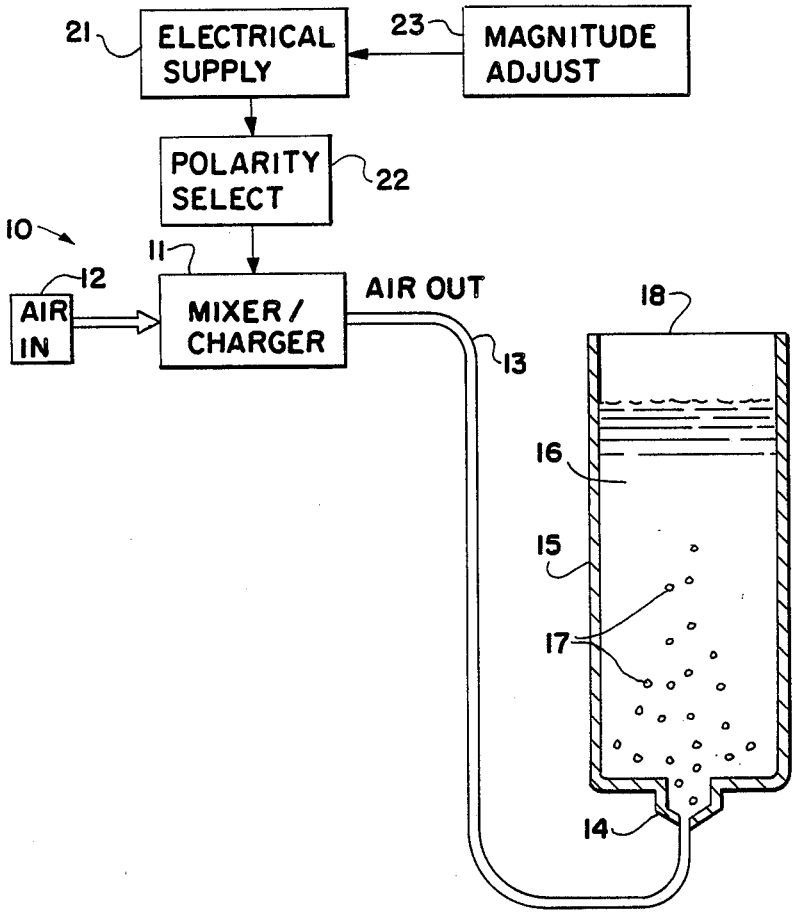
FIG. 1 is a schematic illustration of a charged fluid reaction control apparatus in accordance with the present invention.

Referring initially to FIG. 1, a charged fluid reaction control apparatus is generally indicated at 10. The apparatus 10 includes a mixer/charger 11 of the type disclosed in the above referenced copending patent applications. A more comprehensive description of the mixer/charger 11 exerpted from the first mentioned application above is presented near the end of this specification with reference to FIGS. 4–9. It is the purpose of the mixer/charger 11 to receive a fluid input, in the preferred embodiment air represented at 12, and thoroughly to mix such fluid input and electrically to charge the same to produce in output tube 13 a charged fluid (preferably air) output. The magnitude of charge, the polarity of charge, the flow rate and volume of fluid in the tube 13 may be altered by changed polarity on the mixer/charger, altering the rate of flow through the latter, adjusting the magnitude of electrical charge applied by the mixer/charger to the fluid, etc. The charged air contained in the tube 13 is delivered to an input fitting 14 of a vessel 15, such as a column type device for containing a liquid, for example intended to undergo a chemical reaction. Such liquid schematically is represented at 16.

An example of liquid 16 and the chemical reaction thereof may be water that has a certain alkalinity, e.g. containing carbonates and bicarbonates. Such water may be, for example, Milwaukee, Wisconsin tap water that has a prescribed normal level of alkalinity. To decrease such alkalinity, small amounts of relatively low concentration hydrochloric acid may be added to the vessel 15 for reacting with the carbonates and bicarbonates in the water, as is known.

According to the invention the delivery of charged fluid via tube 13 into the liquid 16 in the vessel 15 effects production of bubbles generally designated 17. The bubbles flow through the liquid and are emitted at the top 18 of the column 15.

It has been discovered by the applicant that the charged bubbles 17 tend to influence the rate of reaction occurring in the liquid 16 even though the material, e.g, air, oxygen, etc., does not itself participate chemically in the reaction between ingredients, e.g. the aforesaid water and hydrochloric acid.

Moreover, applicant has discovered that the amount of effect on the reaction occurring in the liquid 16 by the charged fluid in the tube 13 is a function of the polarity of charge of the charged fluid, of the magnitude of such charge, of the rate of flow of such charged fluid into the liquid 16, of the polar nature or characteristics of the ingredients in the liquid 16, i.e. whether or not the molecule(s) are polar and to what extent they are polar, and the depth of the liquid 16, which would influence the size of the bubbles.

Figure 2:
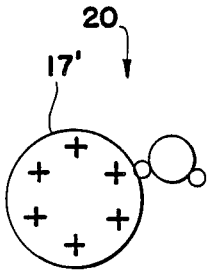
FIGS. 2 and 3 are schematic respresentations of charged air bubbles and the alignment influence thereof on polar molecules contained in a liquid undergoing chemical reaction.
Figure 3:
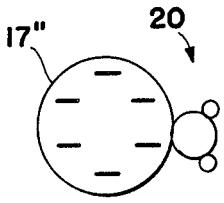

It is believed that the charged fluid produced by the mixer/charger 11, such as air, when delivered to and forming bubbles in the liquid 16 will tend to influence alignment of molecules in the liquid. Such alignment is believed to affect the number of collisions and the number of chemical reacting results due to such collisions during the chemical reaction in the liquid 16. For example, as is shown in FIG. 2, a bubble 17' having a dearth of electrons (such dearth being represented by the plus signs in the bubble 17') tends to cause a prescribed alignment of a molecule 20 with respect to such bubble. Similarly, in FIG. 3 a bubble 17" having an excess of electrons represented by the minus signs in such bubble tends to have a different aligning effect on the molecule 20, which looks like but does not have to be a typical water molecule. It will be seen that the alignment influence on the molecules 20 is different depending on the polarity of the charge of their respective air aubbles 17', 17" and such alignment would affect results of collisions and thus, reaction rate, for example.

It is believed that the reaction rate changes that can be effected using the present invention are similar to those characterized by affectation due to a catalyst. It also has been found that the more polar is (are) the molecule(s) of ingredient(s) in the liquid 16, the greater influence the charged fluid will have on reaction rates.

It has been found that when the charged air delivered to the liquid 16 is of one polarity relative to the polar nature of the molecules in the liquid, the reaction rate may be increased, whereas when the charged air is of the opposite polarity, the reaction rate may be decreased. The depth of the liquid 16 in the column 15 also may have an influence on the reaction rate due to the fact that for a relatively large depth, the bubbles entering at fitting 14 will be relatively small but will tend to expand as they rise, whereas for a relatively shallow depth, the bubble size may be more uniform during rising thereof through the liquid.

Associated with the mixer/charger 11 is an electrical supply 21 providing power to charge fluid flowing through the mixer/charger; a polarity selector switch 22 to determine polarity of charge (from supply 21) applied to fluid flowing through the mixer/charger; and a magnitude adjust device 23, such as a potentiometer, an electronic control, etc., to determine the magnitude of such charge.

It has been found that the charging of air. e.g. flowing at a rate of about one half cubic foot per minute, by the mixer/charger 11 at voltages from somewhat larger than 0 to as large as 20,000 volts but at very low power, for example on the order of several milliamps, can have a significant effect on reaction rate, molecular alignment, chemical bonding, etc.

Referring in detail to FIGS. 4–8, a mixer/charger device in accordance with the preferred embodiment and best mode of the present invention is generally indicated at 11. The mixer/charger 11 includes a fluid inlet 111 for receiving a flow of fluid from an external source, a plurality of disc-like or plate-like members 112, 113 each being generally fluid impermeable and each having one or more fluid passing openings therethrough, such as those shown at 114, 115, a holder mechanism generally indicated at 116 for holding the disc 112, 113 in relative position for directing the flow of fluid through the device 11 (the dics and holder mechanism preferably forming an overall fluid flow path through container 117), and a fluid outlet 118 for directing or coupling fluid from the mixer/charger device 11 as a fluid output therefrom. Preferably the discs 112, 113 are electrically conductive, for example being formed of copper, aluminum or other electrically conductive material, and electrical leads 120, 121 couple such discs to a source of electric energy or electric power 122, for example such as a DC battery, a DC power supply, or any other electrical supply, as may be desired to apply an electric potential across a pair of discs 112, 113 to supply a source of electrons or to remove electrons with respect to fluid flowing through the mixer/charger device 11.

The holder mechanism 116 includes a retainer ring 123 preferably of electrically nonconductive material, which supports the disc 112; an insulator ring/cover 124, which holds the disc 113 and also provides electrical insulation for preferably the entire disc; and a fastener 125, such as a bolt, nut, washer, etc. assembly for example of the type illustrated. It is the purpose of the holder mechanism 116 to cooperate with the discs 112, 113 and with the fluid inlet 11 and fluid outlet 118 to form the container 117 that preferably has substantial fluid-tight integrity to prevent leakage of fluid therefrom while fluid is permitted to flow from the fluid inlet to the fluid outlet. As is described in greater detail below, it is preferably that the flow of fluid through the mixer/charger 11 be substantially unimpeded, although the direction of fluid flow may vary in the device and although the fluid flow may be divided into multiple streams and recombined into a fewer or into one single stream during flow through the mixer/charger 11. By minimizing flow impedance in the mixer/charger 11, dead spots, i.e. spots where fluid tends to stagnate in the device while fluid flows at other portions, and boundary layer formation, both of which would tend to reduce the mixing effectiveness and/or charging effectiveness of the mixer/charger 11, preferably are minimized.

Figure 4:
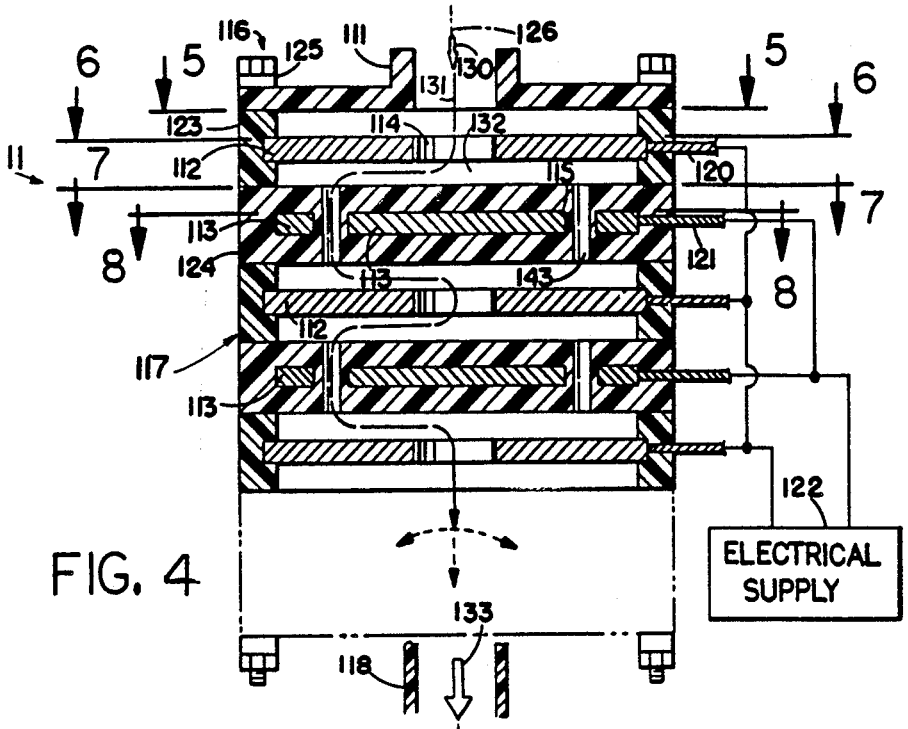
FIG. 4 is an elevation view, partly in section, of a mixer/charger device used in the present invention.
Figure 5:
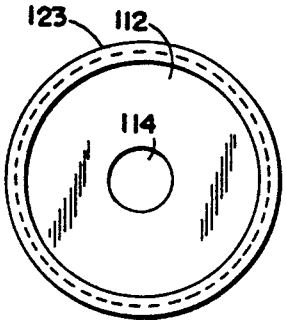
FIGS. 5, 6, 7, and 8 are respective plan views, some partly in section, looking generally in the direction of the respective section lines shown in FIG. 4.
Figure 6:
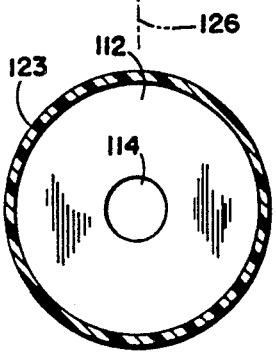
Figure 7:
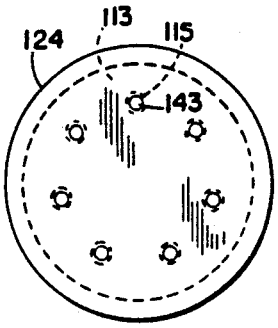
Figure 8:
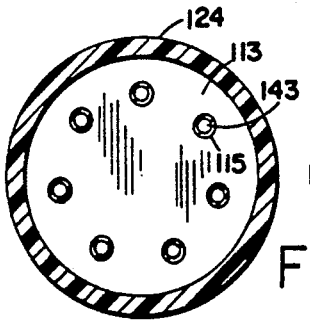

According to fluid flow operation of the mixer/charger 11, an upstream one of the discs 112, 113 provides or serves as an inlet to the next downstream disc. Moreover, one of a pair of discs 112, 113 has a different number of openings therethrough than the other of the discs 112, 113 so that as fluid flows through one disc and then through the next downstream disc, the number of streams of which the overall fluid flow is composed changes. In the illustration of FIG. 4, the most upstream disc 112 has a single opening therethrough and the next downstream disc 113 has a plurality of openings therethrough/. Moreover, to minimize impeding fluid flow through the mixer/charger 11, to avoid dead spots, and to avoid boundary layer formation and detriment vis-a-vis application of charge to fluid flowing through the mixer/charger, the approximate total area of the single opening and the sum of the total areas of the multiple openings in each of the discs are the same. Reference to area here is intended to mean the approximate area across an opening or the sum of the areas across each of the openings through a multiple opening disc, such area being taken approximately in a plane that is normal to the general direction of flow of fluid through such opening.

Further, it is preferred that the openings in respective relatively adjacent discs, such as the pair of discs 112, 113 that immediately follow each other in the mixer/charger 11 of FIG. 4, have respective openings that are relatively offset from each other. Accordingly, the opening 114 in the disc 112 seen in FIG. 4 is approximately at the center of the disc 112 generally along the linear flow axis 126 drawn longitudinally through the mixer/charger 11; and the openings 115 through the disc 113 are at a different radial location relative to the axis 126 offset from the same. Such offset or staggered relationship of the openings 114, 115 enables the openings themselves and the plates in which they are formed to effect a change in the directional flow of the fluid through the mixer/charger preferably also as the number of streams in which the fluid flows changes from plate to plate.

Accordingly, during the flow of fluid through the mixer/charger 11 of FIG. 4, an input supply of fluid is provided at 130 from a supply (not shown), and such fluid flows through the fluid inlet 111. The fluid follows along a flow path represented by the line 131 through the opening 114 in the disc 112. On flowing through the opening 114, the fluid flow changes direction from one generally parallel to the axis 126 to one generally normal to the axis 126. Moreover, during the course of such change in direction, a turbulent mixing of fluid occurs at the area 132. The flow stream then changes direction again to one of the openings 115 in the next downstream disc 113; the fluid passes through such opening 115 and again changes direction as it encounters the impermeable surface of the next downstream disc 112 and then flows toward the opening 114 therein encountering further mixing. Thus, fluid flow along the path 131 results in the dividing and recombining of flow streams, turbulent mixing, and directional changes of fluid flow, all of which cooperate to ensure a highly effective mixing of the fluid. Ultimately, the fluid exits the fluid outlet 118 as an exit flow 133 for subsequent use downstream of the mixer/charger 11.

The arrangement of the retainer ring 123 and insulator ring/cover 124 (FIG. 4) provides the functions of holding the respective discs 112, 113 in appropriate positions in the mixer/charger 11 for effecting the desired fluid flow, mixing and charging functions and preferably also of completing the fluid-tight integrity of the mixer/charger 11 forming the container 117. Preferably the retainer ring 123 is an electrical nonconductor, such as plastic material, and preferably the insulator ring/cover 124 also is of electrically nonconductive material. Examples of the insulator ring/cover 124 may include Mylar brand polyester film available from E. I. DuPont de Nemours, Inc. or vinyl, both materials available as a sheet of material having an adhesive material on one surface to fasten the same to a disc 113 sandwiching the disc between respective sheets of such insulator. Preferably also the holes 115 in the disc 113 are fully insulated so that the actual passage through such holes or openings 115 are effected via overall passages 143 formed through the insulator. The purpose of the insulator is described in further detail below. One or both of the retainer ring 123 and insulator ring/cover 124 may include additional relatively rigid portions that cooperate with each other and with the fastener 125 to form the container 117 of the mixer/charger 11.

To effect application of electrons to fluid flowing through the mixer/charger 11 or to remove electrons from such fluid, electrical power is provided from power source 122 across respective pairs of discs 112, 113. Thus, for example, an electric potential may be connected via leads 120, 121 to one or more pairs of relatively adjacent discs 112, 113, as is seen in FIG. 4, for example. Application of charge to a fluid flowing through a mixer/charger 11 according to the invention was achieved using a voltage applied across a pair of relatively adjacent discs 112, 113 in the range of from greater than 0 to approximately 25,000 volts with a current flow in the milliamp range. Satisfactory charing of air flowing through the mixer/charger device 11 at a rate of approximately ½ cubic foot per minute was accomplished using such electrical energy levels. Such charging may be the application of electrons to the air, for example by providing a source of electrons or supply of electrons to the disc 112 while the insulated disc 113 is maintained at a relatively lower electric potential. Alternatively, the polarity could be reversed whereby a supply of electrons would be provided the insulated disc 113 while the disc 112 was at a relatively lower electric potential; in this case electrons essentially are removed from the fluid. Thus, according to the invention, reference to charging of fluid may refer equivalently to the application of electrons or the removal of electrons with respect to the fluid.

The mixer/charger 11 functions in a sense as a capacitor whereby the relatively adjacent discs 112, 113, for example, form the opposite plates of the capacitor, and the dielectric constant of the capacitor may be a function of the dielectric constant of the insulator ring/cover 124 and the dielectric constant of the fluid between adjacent discs. Thus, if the fluid were air, the mixer/charger 11 would function like an air capacitor. Such capacitor according to the invention, then, is provided with a controlled bleed of electric charge, and such bleed may be a function of the aforementioned dielectric constant values, of the usual parameters, such as capacitor plate size, temperature, voltage and/or current values, etc., and such controlled bleed may also be a function of the flow rate of fluid through the mixer/charger 11. The flow rate and/or mixing may alter the effective distribution of charge in the fluid, the wiping or scrubbing action of the fluid against respective discs and/or the insulator ring/cover 124 surface(s), etc. As the fluid mixes during flow, charge tends to be distributed through the fluid thereby helping to maximize the overall charging as the fluid flows across and through respective discs. As the area of the openings 114 and the sum of the areas of the openings 115 in respective discs is approximately the same, dead spots and boundary layers will be minimized and preferably avoided in total so as to maximize the continuing flow of fluid through the mixer/charger, distribution of charge in the fluid, wiping action of the fluid against respective discs, etc.

It is noted here that although reference to wiping of a disc, such as a disc 113, may be stated herein, in the event such disc is protected by an insulator ring/cover 124, for example as is shown in FIG. 4, such referral indicates wiping action against the exposed surface area of the insulator ring/cover 124. In any event, as the fluid wipes across or scrubs over respective discs, charge is transfered or removed with respect to the fluid, i.e. electrons are added or removed with respect to the fluid. Additionally, since there is a relatively large surface area available in the mixer/charger 11 for such charge transfer, a greater concentration of charge and transfer thereof to fluid flowing through the mixer/charger can be accomplished than was heretofore possible in prior art devices.

After a fluid has been charged in the mixer/charger 11, it may be desirable to maintain such charge for a maximum period of time. For such purposes, it is desirable that the fluid outlet 118 be of an electrically nonconductive material that tends not to dissipate, to bleed, to ground, or otherwise to affect the charge of the fluid 113 as the same passes through the fluid outlet 118. It also may be desired to form the fluid inlet 111 of material similar to that of which the fluid outlet 118 is made in order to avoid pre-charging or pre-affecting the charge of the fluid input 130; alternatively, in order to help neutralize any pre-existing charge on the input fluid 130, it may be desired to select the fluid inle 111 to be of a material that is electrically conductive and does in fact tend to neutralize pre-existing charge. Furthermore, if desired, the container 117 may include an additional housing (not shown) surrounding those portions of the mixer/charger 11 illustrated in FIG. 4 for further fluid-tight integrity thereof, electrical isolation thereof, thermal insulation thereof, etc.

Figure 9:
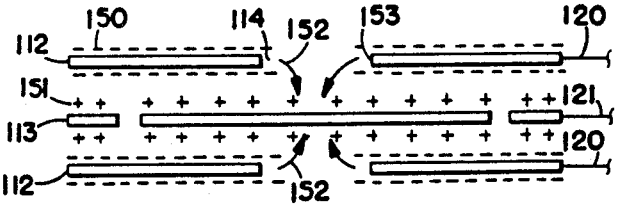
FIG. 9 is a schematic illustration of charge distribution and flow in a mixer/charger device according to the invention.

Turning now to FIG. 9, three representative discs 112, 113 are illustrated coupled by respective leads 120, 121 to an electrical supply. The discs 112 are shown having a source or excess supply of electrons (represented by minus signs) and the disc 113 is shown having a dearth of electrons, i.e. being at a relatively lower relative electric potential (with representation thereof being shown by the plus signs 151 on both sides thereof). Arrows 152 represent tendency of electrons to flow from the source thereof toward the source of relatively lower electrical potential. Due to such tendency of electron flow represented by arrows 152, the edge 153 circumscribing the center opening 114 in each disc 112 tends to become an area of rather high electrical stress, this in particular when the discs 112 have the source of electrons. (Such discs 112 may be considered electrically, i.e. in conventional electrical engineering terms, as the positive plate and the disc 113 may be considered the ground plate or relatively negative plate in such circumstances, according to ordinary convention.)

In using the mixer/charger of the invention, then, it will be appreciated that a fluid is provided to the mixer/charger. The mixer/charger thoroughly mixes the fluid by changing the number of streams in which the fluid is flowing from one or a relatively few streams to a relatively larger number of streams while also changing the flow direction of the various streams and enabling a relatively turbulent mixing of the fluid between and at respective discs. Simultaneously electric charge is applied or removed with respect to the fluid flowing through the mixer/charger.

The discs may be plate-like, fluted, truncated conical, etc. and preferably are of electrically conductive material, such as copper, aluminum, steel, or the like, preferably being impermeable to fluid flow other than at the distinct openings therethrough. The retaining ring 123 and the insulator ring/cover preferably are of electrically nonconductive material as also preferably is the fluid inlet 111 and fluid outlet 118.

I claim:

1. Apparatus for affecting a chemical reaction, comprising:

mixer/charger means for simultaneously mixing and electrically charging a fluid to produce a charged fluid, chemical reaction containment means for containing ingredients undergoing a chemical reaction separately from said mixer/charger means, and means for transmission of the charged fluid from said mixer/charger means to said containment means, whereby the rate of the chemical reaction may be influenced, and wherein said mixer/charger means comprises inlet means for receiving a flowing fluid, outlet means positioned to receive fluid from said inlet means and for directing an electrically charged flowing fluid out of said mixer/charger means, cooperative means for dividing at least one stream of fluid into plural streams and for at least once changing at least one of the relative flow direction and relative location of at least part of one of the streams, and charge coupling means for adding or removing an electrical charge with respect to one of said inlet means and outlet means to affect the electrical charge on the fluid flowing through the mixer/charger.

2. The apparatus of claim 1, said containment means comprising a tubular column containing liquid ingredients undergoing chemical reaction.

3. The apparatus of claim 1, further comprising electrical supply means for providing electrical input to said mixer/charger means.

4. The apparatus of claim 3, further comprising an air supply means for providing air as a fluid input to said mixer/charger means.

5. The apparatus of claim 3, further comprising polarity select means for selecting the polarity of electrical power delivered to said mixer/charger means to determine the polarity of charging of the fluid.

6. The apparatus of claim 3, further comprising magnitude adjust means for determining the magnitude of charging of the fluid.

7. A method of affecting a chemical reaction, comprising simultaneously mixing and electrically charging a gas to produce an electrically charged gas, and bubbling said electrically charged gas through a liquid medium in which a chemical reaction is occurring, in order to influence the reaction rate of the chemical reaction.

8. The method of claim 7, further comprising controlling the polarity of such charged gas.

9. The method of claim 7, further comprising controlling the magnitude of charge of such charged gas.

10. The method of claim 7, further comprising supplying air as said gas.

* * * * *